United States Patent [19]

Akita

[11] 4,406,145

[45] Sep. 27, 1983

[54] ROLL CHANGING APPARATUS FOR ROLLING MILLS

[75] Inventor: Shinji Akita, Yokohama, Japan

[73] Assignee: Nippon Kokan Kabushiki Kaisha, Tokyo, Japan

[21] Appl. No.: 312,941

[22] Filed: Oct. 20, 1981

[30] Foreign Application Priority Data

Oct. 21, 1980 [JP] Japan ..... 55-146259

[51] Int. Cl.³ ..... B21B 31/08

[52] U.S. Cl. ..... 72/239

[58] Field of Search ..... 72/237, 238, 239

[56] References Cited

U.S. PATENT DOCUMENTS 3,451,244 6/1969 Stover et al. ..... 72/239

3,475,939 11/1969 Bier ..... 72/239

3,540,253 11/1970 Kollek et al. ..... 72/239

FOREIGN PATENT DOCUMENTS 1033032 6/1966 United Kingdom ..... 72/239

*Primary Examiner*—Lowell A. Larson

*Assistant Examiner*—Jonathan L. Scherer

*Attorney, Agent, or Firm*—Fleit, Jacobson & Cohn

[57] ABSTRACT

A roll changing apparatus for rolling mills which is adapted for use in the manufacture of seamless steel pipes. The apparatus comprises a pair of sliding bases each mounted on a base block and movable parallel to each other, a plurality of roll carriages each containing a set of rolls, and means for moving the roll carriages, wherein two or more of the roll carriages are placed on each of the sliding bases and at least one of the roll carriages on each sliding base is moved forward to form a roll mill. When the roll carriages are to be changed, the forwardly moved roll carriages are moved back onto the sliding bases and then the other roll carriages are moved forward, thus automatically accomplishing the roll carriage changing in a short period of time.

4 Claims, 2 Drawing Figures

ROLL CHANGING APPARATUS FOR ROLLING MILLS

The present invention relates to an apparatus for changing the housings containing rolling roll sets, which is used in the manufacture of seamless steel pipes or the like.

In the manufacture of seamless steel pipes or the like, various rolling mills (piercer, pipe expander, etc.) are used and the rolling rolls of these rolling mills wear comparatively rapidly or tend to cause defects in the roll surfaces due to the rolls being always pressed against hot materials to be worked. As a result, the rolling rolls must be changed from time to time and the rolling rolls of some rolling mills must also sometimes be changed depending on the size of material to be worked. Since changing of the rolling rolls requires much time for the changing operation, adjustments, etc., it has been the practice to preliminarily prepare a large number of housing containing rolling roll sets such that the old housings are lifted and removed by an overhead crane and new housings are put in place by the overhead crane and set up.

However, this known changing method is disadvantageous in that the housing changing operation requires much labor and time and moreover the overhead crane is used exclusively for this purpose making it impossible to use the crane for other operations. For this reason, provision of an exclusive gantry crane has been proposed as a special housing changing apparatus and this method has not been put in practical use due to the excessively high equipment cost required.

It is therefore the object of the present invention to provide an improved roll changing apparatus for rolling mills, which is so designed that the changing operation of roll carriages equipped with rolling roll sets can be accomplished in a short period of time and automatically without using any overhead crane and with a greatly reduced equipment cost.

In accordance with the present invention there is thus provided a roll changing apparatus for rolling mills comprising a pair of sliding bases each arranged on a base plate and movable parallel to each other, a plurality of roll carriages each carrying a set of rolls and means for moving the roll carriages, whereby more than two of the roll carriages are mounted on each of the sliding bases and at least one or more of the roll carriages on each sliding base are moved forward to form a rolling mill. When the roll carriages are to be changed, the roll carriages in the forward positions are moved back onto the sliding bases and then the sliding bases are moved parallel to each other thereby moving the other roll carriages forward.

Figure 1:
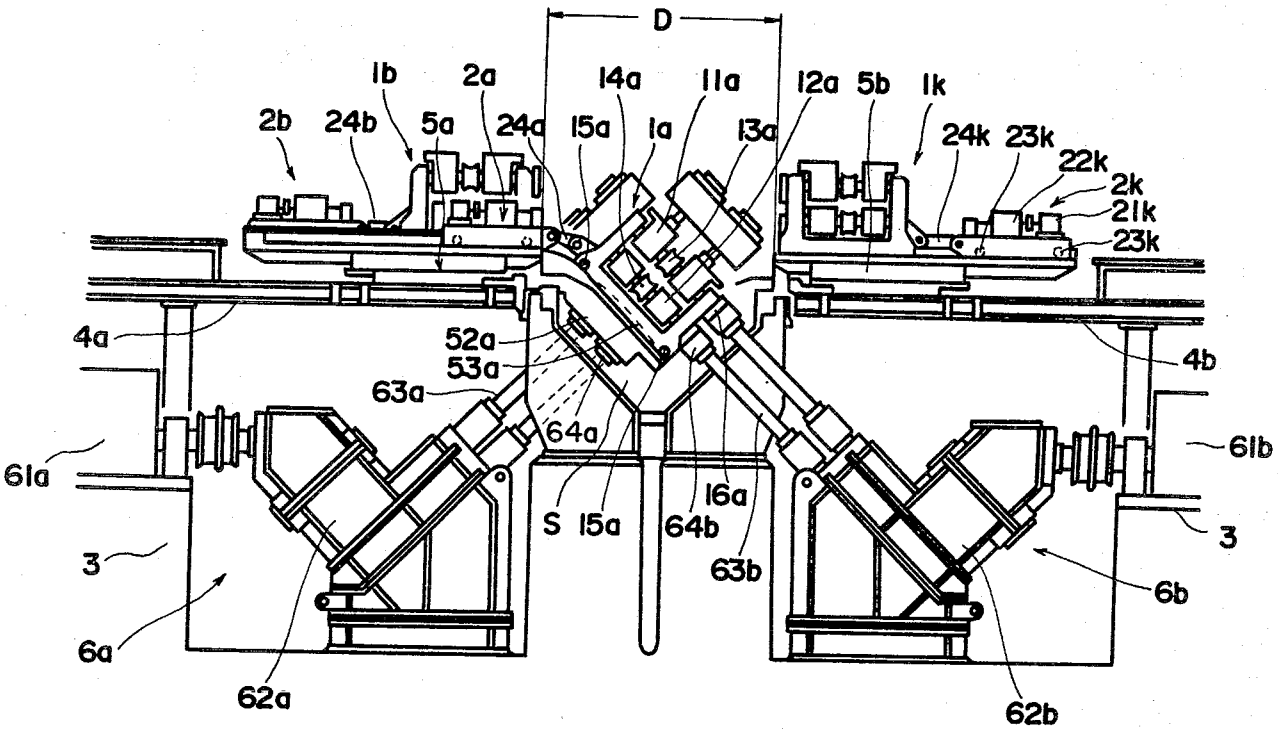
Figure 2:
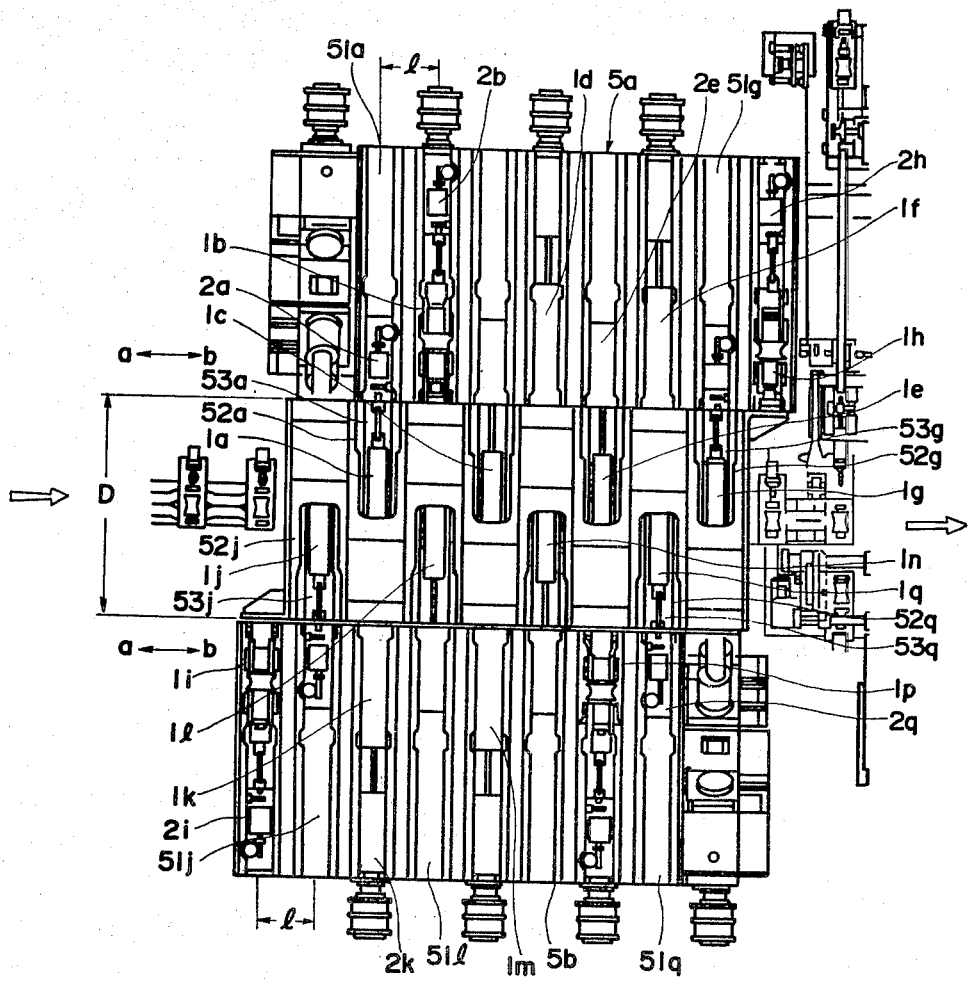

For a better understanding of the invention reference is made to the following more detailed description taken in conjunction with the accompanying drawings, in which:

FIG. 1 is a front view showing an embodiment of the invention applied to a rolling mill in which eight sets of rolling rolls are arranged alternately and inclined at an angle of 45°; and FIG. 2 is a plan view of FIG. 1.

The present invention will now be described with reference to the illustrated embodiment.

In the accompanying drawings, numerals 1*a* to 1*q* designate roll carriages of the same construction and the roll carriage 1*a*, shown by way of example, includes two rolling rolls 13*a* and 14*a* respectively attached to each pair of chocks 11*a* and 12*a* and arranged in opposite positions and rollers 15*a* provided on the lower part of the carriage. Numeral 16*a* designates couplings for the driving shafts of the rolling rolls 13*a* and 14*a*. Numerals 2*a* to 2*q* designate transfer carriages of the same construction which are respectively associated with the roll carriages 1*a l to 1q* and the transfer carriage 2*k*, shown by way of example, includes a motor 21*k*, a reduction gear 22*k*, and rollers 23*k* mounted on the lower part of the carriage. The transfer carriages 2*a* to 2*q* are respectively coupled to the roll carriages 1*a* to 1*q* by links 24*a* to 24*q*.

Numerals 4*a* and 4*b* designate a pair of base plates which are fixedly mounted on base blocks 3 with a predetermined spacing therebetween. Numerals 5*a* and 5*b* designate a pair of sliding bases arranged on the base plates 4*a* and 4*b* in opposition at a predetermined distance D apart, and a space S is formed between the sliding bases 5*a* and 5*b*. The sliding bases 5*a* and 5*b* are constructed so that they are respectively slidable over the base plates 4*a* and 4*b* by a predetermined distance l in either of the arrowed directions a and b by driving units (not shown) comprising hydraulic units or the like.

Also provided on the upper surfaces of the sliding bases 5*a* and 5*b* are grooves or rails 51*a l to 51q* (hereinafter referred to as rails) which are arranged transversely at equal spaces, and the roll carriages 1*a* to 1*q* and the transfer carriages 2*a* to 2*q* are respectively arranged on the rails 51*a* to 51*q* so as to be moved therealong. The required number of the rails 51*a* to 51*q* is two times the number of the roll carriages required for the rolling mill, that is, the number of the rails provided on each of the sliding bases 5*a* and 5*b* is 8 since the present embodiment requires four of the roll carriages on each side of the mill.

Numerals 52*a* to 52*h* designate supporting members having their one end positioned adjacent to the sliding base 5*a* or 5*b* and arranged so as to be opposite to alternate ones of the rails 53*a* to 53*d* on the sliding base 5*a* and the rails 53*e* to 53*h* on the sliding base 5*b*. The supporting members 52*a* to 52*h* are each attached downwardly to the base block 3 or the base plate 4*a* or 4*b* at an angle of 45° with respect to the sliding base 5*a* or 5*b*. The supporting members, 52*a* to 52*h* are respectively provided with rails 53*a* to 53*h* which are substantially the same shape as the rails 51*a* to 51*q* provided on the sliding bases 5*a* and 5*b* and curved with a large radius as shown in FIG. 1. Numerals 6*a* and 6*b* designate drive systems for the rolling rolls respectively comprising motors 61*a* and 61*b* mounted on the base blocks 3, reduction gears 62*a* and 62*b*, driving shafts 63*a* and 62*b* and couplings 64*a* and 64*b*.

With the apparatus of this invention constructed as above described, the roll carriages 1*a*, 1*c*, 1*e*, 1*g* and 1*j*, 1*l*, 1*n*, 1*q* are alternately moved onto the supporting members 52*a* to 52*h* to form a rolling mill shaped like an X. In this condition, a material to be worked is fed to the rolling mill from the direction of the left arrow in FIG. 2 so that the material is rolled by the rolling rolls and it is then delivered to the direction of the right arrow. On the other hand, the rolling rolls on the other roll carriages 1*b*, 1*d*, 1*f*, 1*h* and 1*i*, 1*k*, 1*m*, 1*p* have been changed with new rolls and adjustments have been completed thus placing then in condition for use at any time.

The main points of the roll carriage changing by the apparatus of this invention will now be described.

Firstly, the roll carriages which have been in use are disconnected with the couplings of the driving systems and the transfer carriages 2a, 2c, 2e,–2q are operated to withdraw the roll carriages 1a, 1c, 1e,–1q onto the sliding bases 5a and 5b. In this condition, the sliding base 5a is moved the distance l in the direction a and the other sliding base 5b is also moved the distance l in the direction b, thus aligning the rails 53a, 53b,–53h of the supporting members 52a, 52b,–52h respectively with the rails 51b, 51d, 51f,–51p on which the stand-by roll carriages 1b, 1d, 1f,–1p are placed. Then, the transfer carriages 2b, 2d, 2f,–2p are operated to move the roll carriages 1b, 1d, 1f,–1p onto the supporting members 52a, 52b,–52h and the roll carriages 1b, 1d, 1f,–1p are fixedly placed in position. Then, the couplings 16a, 16b,–16q are connected with the couplings 64a and 64b of the driving shafts 63a and 63b and thus the rolling rolls 13a, 14a,–13q, 14q are positioned in place.

The used rolls which have been withdrawn onto the sliding bases 5a and 5b may be changed with new rolls at a proper time so that during the next roll carriage changing the sliding bases may be moved in the directions opposite to previously and the used roll carriages may be changed with the new roll carriages.

While, in the embodiment described above, the roll carriages are inclined at an angle of 45° and arranged alternately, the present invention can be equally applied to a rolling mill in which the roll carriages are positioned horizontally. Also, while the eight roll carriages are arranged alternately, the invention can be applied to all types of rolling mills including one or more roll carriages. Moreover, while the roll carriages are moved by the motor-driven transfer carriages, the transfer carriages may be replaced with any other driving means such as hydraulic drives. Still further, while, in the above-described embodiment, the two sliding bases are arranged in the opposite positions and the roll carriages carried on the sliding bases are alternately moved forward to form a rolling mill, in the case of rolling mills using a small number of rolls two or more roll carriages may be placed on a single sliding base and the roll carriages may be moved parallel to each other to change the roll carriages.

What is claimed is:

1. A roll changing apparatus for rolling mills comprising:

a pair of sliding bases carrying rails, said bases being arranged on base blocks to oppose each other and to be movable parallel to each other;

a plurality of roll carriages arranged on each of said sliding bases to be parallel to one another in a direction perpendicular to the direction of sliding of each said sliding base, each of said roll carriages incorporating a set of rolls;

means for moving each of said roll carriages;

a plurality of supporting members for said roll carriages on each of said sliding bases provided each for every other one of said roll carriages, said supporting members carrying rails and being arranged alternately within a space formed between said sliding bases, each of said support members having one end thereof positioned adjacent to one of said sliding bases and another end thereof obliquely extended downwardly;

roll sets supported by said roll carriages; and means for driving said roll sets supported by said roll carriages on said supporting members through detachable coupling means;

said means for moving each of said roll carriages including link means for adapting each said roll carriage for elevation and depression, whereby a rolling mill shaped like an X is formed by the roll sets supported by said roll carriages on said supporting members within said space, and said sliding bases are moved parallel to each other and in the opposite directions with respect to said supporting members a distance of one roll carriage so as to align said rails on said supporting members selectively with said rails on said sliding bases.

2. A roll changing apparatus according to claim 1, wherein each of said supporting members is inclined downward at an angle of 45° within said space.

3. A roll changing apparatus according to claim 1, wherein the rails on said supporting members are curved upwardly with a large radius.

4. A roll changing apparatus for rolling mills comprising:

a pair of sliding bases each arranged on a base block to oppose each other and movable parallel to each other;

a plurality of roll carriages arranged on each of said sliding bases to be parallel to one another in a direction perpendicular to the direction of sliding of each said sliding base, each of said roll carriages incorporating a set of rolls;

means for moving each of said roll carriages;

a plurality of supporting members for said roll carriages on each of said sliding bases provided each for every other one of said roll carriages, said supporting members arranged alternately within a space formed between said sliding bases, each of said supporting members having one end thereof positioned adjacent to one of said sliding bases and another end thereof obliquely extended downwardly;

and means for driving said roll sets supported by said roll carriages on said supporting members through detachable coupling means;

said means for moving each said roll carriage including link means for adapting each said roll carriage for elevation and depression, whereby a rolling mill shaped like an X is formed by the roll sets supported by said roll carriages on said supporting members within said space, and said sliding bases are moved parallel to each other and in the opposite directions with respect to said supporting members a distance of a plurality of roll carriages so as to align rails on said supporting members selectively with rails on said sliding bases.

* * * * *